US007629544B1

(12) United States Patent
Gibboney, Jr.

(10) Patent No.: US 7,629,544 B1
(45) Date of Patent: Dec. 8, 2009

(54) ASYMMETRIC SPRING COIL SHUNT FOR LIGHT STRING SOCKET

(75) Inventor: James W. Gibboney, Jr., Conyers, GA (US)

(73) Assignee: Tech Patent Licensing, LLC, St. Augustine, FL (US)

( * ) Notice: Subject to any disclaimer, the term of this patent is extended or adjusted under 35 U.S.C. 154(b) by 0 days.

(21) Appl. No.: 12/421,151

(22) Filed: Apr. 9, 2009

Related U.S. Application Data

(60) Provisional application No. 61/059,896, filed on Jun. 9, 2008, provisional application No. 61/058,249, filed on Jun. 3, 2008, provisional application No. 61/058,248, filed on Jun. 3, 2008.

(51) Int. Cl.
*H01R 33/96* (2006.01)

(52) U.S. Cl. ..... 200/51.1; 439/188; 315/122

(58) Field of Classification Search ..... 200/51.1, 200/51.09, 51 R; 439/188, 513, 699.2, 619; 315/122, 119
See application file for complete search history.

(56) References Cited

U.S. PATENT DOCUMENTS

| | | | |
|---|---|---|---|
| 348,875 | A | 9/1886 | Wightman et al. |
| 975,090 | A | 11/1910 | Wappler |
| 3,294,932 | A | 12/1966 | Barlow |
| 3,345,482 | A | 10/1967 | Shih-Woo |
| 3,359,523 | A | 12/1967 | Shih-Woo |
| 4,233,543 | A | 11/1980 | Hickok |
| 4,350,407 | A | 9/1982 | Tong |
| 4,644,451 | A | 2/1987 | Chabria |
| 4,654,766 | A | 3/1987 | Tung |
| 4,894,499 | A | 1/1990 | Hans et al. |
| 4,991,071 | A | 2/1991 | Braasch |
| 5,139,343 | A | 8/1992 | Lin |
| 6,533,437 | B1 | 3/2003 | Ahroni |
| 6,583,536 | B1 | 6/2003 | Gibboney |
| 6,609,814 | B2 | 8/2003 | Ahroni |
| 7,186,017 | B2 | 3/2007 | Kuo |
| 7,264,392 | B2 | 9/2007 | Massabki et al. |
| 7,449,643 | B2 | 11/2008 | Nakade |
| 7,453,194 | B1 | 11/2008 | Gibboney |
| 7,473,024 | B2 | 1/2009 | Gibboney |
| 7,484,995 | B2 | 2/2009 | Ding |
| 7,591,658 | B2 * | 9/2009 | Chen ..... 439/188 |
| 2003/0156412 | A1 | 8/2003 | Limber et al. |

(Continued)

FOREIGN PATENT DOCUMENTS

| | | |
|---|---|---|
| GB | 1164257(A) | 9/1969 |

(Continued)

*Primary Examiner*—Felix O Figueroa
(74) *Attorney, Agent, or Firm*—Michael A. Mann; Nexsen Pruet, LLC

(57) ABSTRACT

A mechanical shunt for use in a socket of a string of lights resides in an otherwise typical lamp of a string of lights. The present shunt is a coiled spring shunt inserted in part into a hole formed in one of the electrical terminals in the socket so that it is cantilevered toward the opposing electrical terminal. The bulb holder carries a projection or a "tooth" on its bottom corner that is interposed between the first, cantilevered end of the spring terminal and the first electrical terminal when the holder is inserted into the socket. When the bulb and holder are removed, the spring shunt resiliently returns to engagement with the first electrical terminal.

5 Claims, 2 Drawing Sheets

U.S. PATENT DOCUMENTS

2003/0214212 A1 11/2003 Gibboney, Jr.
2006/0207866 A1 9/2006 Bonn et al.
2007/0001058 A1 1/2007 Severson
2007/0297196 A1 12/2007 Massabki et al.
2008/0129176 A1 6/2008 Jigamian

FOREIGN PATENT DOCUMENTS

JP 2006196241(A) 7/2006

* cited by examiner

ASYMMETRIC SPRING COIL SHUNT FOR LIGHT STRING SOCKET

CROSS REFERENCE TO RELATED PATENTS

The present application claims the priority benefit of U.S. provisional patent application Ser. No. 61/059,896, filed Jun. 9, 2008, which is herein incorporated in its entirety by reference. The present application is related to U.S. provisional applications 61/058,249 filed Jun. 3, 2008, 61/058,248 filed Jun. 3, 2008; and U.S. non-provisional application Ser. Nos. 12/133,800 filed Jun. 5, 2008, and 12/134,528 filed Jun. 6, 2008, in that all four applications are commonly owned and are directed to related subject matter.

BACKGROUND OF THE INVENTION

The present invention relates to light strings such as are used for holiday lighting, and in particular to mechanical shunts for passing electrical current to the next light in the string if the bulb is loose or missing.

Strings of lights are typically wired electrically in series. Consequently, when one light in the string burns out or is removed, all the lights in the string go out. Determining which light needs to be replaced is tedious. If the string has 50 or more lights and the string is attached to a Christmas tree, finding the burned out or missing bulb can be very tedious.

For a number of years, this problem has been solved, or at least avoided, by the use of shunts that allow current to pass directly between the terminals of the defective lamp, bypassing the missing or defective bulb filament. Passing electrical current from one lamp to the next regardless of the condition of the bulb in any individual lamp allows the remaining lamps to continue to operate.

Shunts are typically found in two places in prior art lamps, namely, in the glass globe and in the socket. The shunts inside the glass globe are typically made of wire wrapped around the conductive elements (called Dumet wires). When the filament fails, the oxide coating on the wires that theretofore prevented direct conduction of electricity is burned off and the coil welds itself to the Dumet wires, thereby providing a new electrically conductive path for passing the electrical current.

Of the shunts that are located in the socket, there are two types, namely, solid state shunts and mechanical shunts. Among the mechanical shunts, for example, there is a set of spring contact terminals that is the subject of U.S. Pat. No. 6,257,740. These spring contacts are pushed apart when the lamp base is inserted into the socket and spring back together when the base is removed, thereby allowing the current to pass from one terminal to the other directly. This type is strictly for use when the bulb (and its base) is removed and does not address the issue of a burned out bulb. This type of shunt works well and has enjoyed commercial success.

Another mechanical shunt is disclosed in U.S. Pat. No. 7,253,556, which is invented by the present inventor and is commonly owned by applicant. This mechanical shunt is a nearly horizontal flat strip of metal held in place between the two electrical terminals in a light socket by a shunt holder. The ends of the shunt extend laterally and slightly downwardly to engage the electrical terminals mounted to the socket wall. When the lamp base, which is hollow, is inserted into the socket, the shunt holder together with its shunt is received inside the hollow base, and, as the shunt enters the base, its lateral ends are bent down and away from the electrical terminals on the socket wall, thereby allowing electrical current to pass to and through the Dumet wires and thence to the filament in the bulb rather than directly through the shunt between the electrical terminals.

U.S. Pat. No. 6,609,814 issued to Ahroni teaches an asymmetrical mechanical shunt composed of two portions that are nearly co-planar and in electric contact with each other and the electrical terminals mounted on the wall of his socket. When a first of the two portions is pressed down and thus out of engagement and electrical connection with the second of the two portions of the shunt by inserting the bulb holder into a socket, current is redirected through the lamp. The first portion resiliently resumes electrical contact with the second portion when the bulb holder is removed from the socket. Ahroni also teaches a mechanical shunt composed of a spring in a spring retainer positioned between the opposing electrical terminals in the socket and having spherical contacts at either end that contact the electrical terminals in the socket The bulb holder taught by Ahroni has an engagement spike extending therefrom that is driven between one of the spherical contacts and its respective electrical terminal thus opening the shunt.

Manufacturers of miniature lamps are concerned with cost of materials and labor. Small lamps are assembled largely by hand. Accordingly, small components that need to be added to the socket increase labor costs as well as material costs. While individual lamp material costs are trivial, the huge number of miniature lights made and sold every year in a competitive marketplace collectively result in costs for labor and materials that are substantial. Correspondingly, even small changes that, for example, reduce material requirements, simplify manufacturing, or improve safety or reliability, make a huge difference in the costs to manufacture. Accordingly, there remains a need for a better mechanical shunt for use in the sockets of the lamps of light strings.

SUMMARY OF THE INVENTION

According to its major aspects and briefly recited, the present invention is an asymmetrical mechanical shunt for use in the sockets of lamps of a light string. When the lamp is missing from the socket, the shunt redirects the current flow across the terminals in the socket and to the next light in the string of lights. When the lamp is inserted, the bulb holder breaks electrical contact between the shunt and one of the two terminals inside the lamp socket thereby directing the current back through the bulb filament. The term asymmetric in connection with the present shunt, therefore, refers to the fact that the connection between the terminal in the socket and the shunt is broken on only one end of the shunt.

A lamp with the present shunt is typical-looking from the exterior. Furthermore, the present bulb is similar to prior art bulbs, with a filament and a pair of Dumet wires extending from inside the bulb to the outside where they pass through holes formed in the bulb holder. Also typical of prior art lamps are the two opposing electrically conducting terminals carried on the interior wall of the socket. The bulb holder, however, has a projection or "tooth" formed on one of its two bottom corners. Furthermore, one of the two conducting terminals has a small hole formed therein that is dimensioned to receive one end of the spring shunt. That end of the shunt is inserted far enough into the hole in the terminal for it to be held securely and allow the opposing end of the shunt to be cantilevered across the interior of the socket toward the opposing terminal. The spring is long enough so that, when the bulb holder is not in the socket, it presses against the second conducting terminal. When the bulb holder is inserted into the socket, the tooth on the bottom corner of the bulb holder bends the cantilevered end of the spring shunt down and away from the terminal, out of electrical engagement with the conducting terminal so that electrical current can pass from that conducting terminal through the Dumet wires and the filament inside the bulb and back to the second conducting terminal.

An important advantage of the present invention is the simplicity of its manufacture. There is one extra step beyond the assembly of a typical, prior art, "shuntless" lamp. One end of a spring is inserted into a hole in one of the terminals before that terminal is inserted into the socket as usual.

Another important feature of the present shunt is that the tooth on the corner of the bulb holder not only serves to activate and deactivate the shunt depending on whether the holder is being removed from the socket or inserted into the socket, respectively, but it also helps with alignment of the socket and holder. If the holder does not seat easily in the socket, it is apparently 180° out of alignment and must be rotated accordingly.

These and other features and their advantages will be apparent to those skilled in the art of light string electrical design from a careful reading of the Detailed Description of Embodiments accompanied by the following drawings.

DETAILED DESCRIPTION OF THE INVENTION

Figure 1:
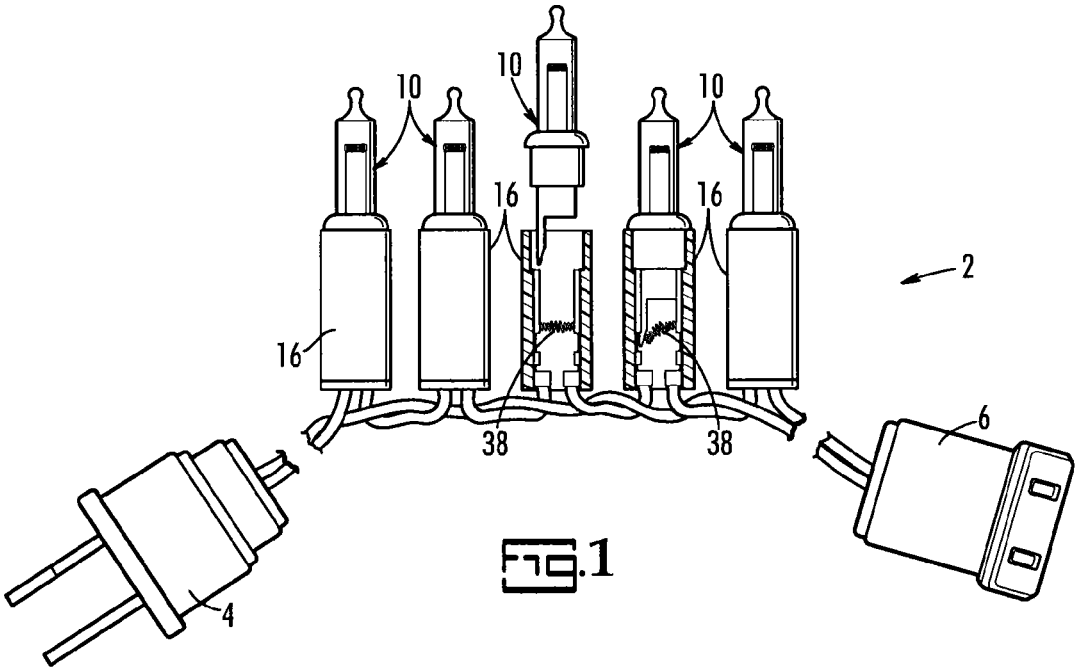
FIG. 1 is a side view of a light string with two of the sockets partially cut away and one of the bulbs and its holder removed from one of the two partially cut-away sockets, according to a preferred embodiment of the present invention.

The present invention is a lamp socket with a mechanical shunt for use in a string of lights as shown in FIG. 1. As will be described herein in detail, the shunt, when activated by the removal of the lamp, shifts the flow of the electrical current from a first path leading between a first and an opposing second electrical terminals in the wall of the socket through a filament in the bulb to a second path that bypasses the filament and flows through the shunt between the first and second electrical terminals. The term "lamp" refers to a bulb, bulb holder, Dumet wires, and a filament. The term "light" refers to a lamp along with a socket, shunt, electrical terminals, and insulated wires supplying power to the lamp. The term "light string" refers to plural spaced-apart lights connected in series by insulated wires.

FIG. 1 shows a string of lights 2 with sockets 16 constructed according to one embodiment of the present invention and with a plug 4 at one end and a receptacle 6 at the other end. Two of the sockets 16 are shown in cross-section, one of which is shown with a lamp 10 partially removed and with a shunt 38 in the closed position ready to route electrical current between a first and an opposing second electrical terminal 30 and 32. The other of the two sockets shown in cross-section has the lamp 10 inserted into socket 16 with shunt 38 in the open position and contacting only one electrical terminal 32, allowing current to run through Dumet wires 24 and 26 and then to the filament 22 (FIG. 3).

Figure 2:
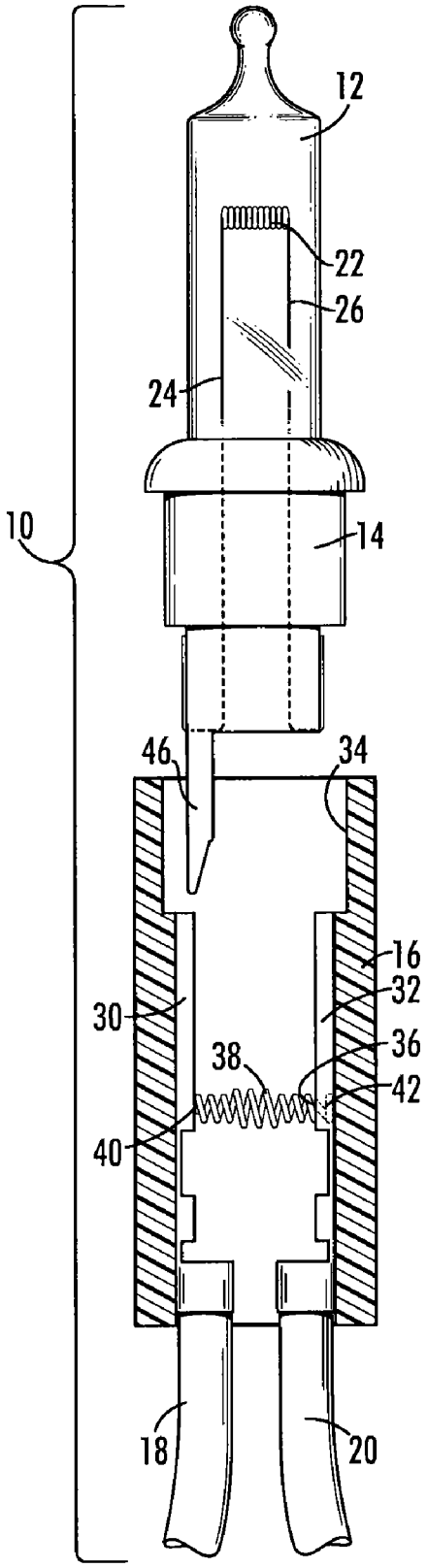
FIG. 2 is a side cross-sectional view of the socket of the present invention showing the lamp partially removed and the shunt in electrical connection with both electrical terminals within the socket, according to one embodiment of the present invention.
Figure 3:
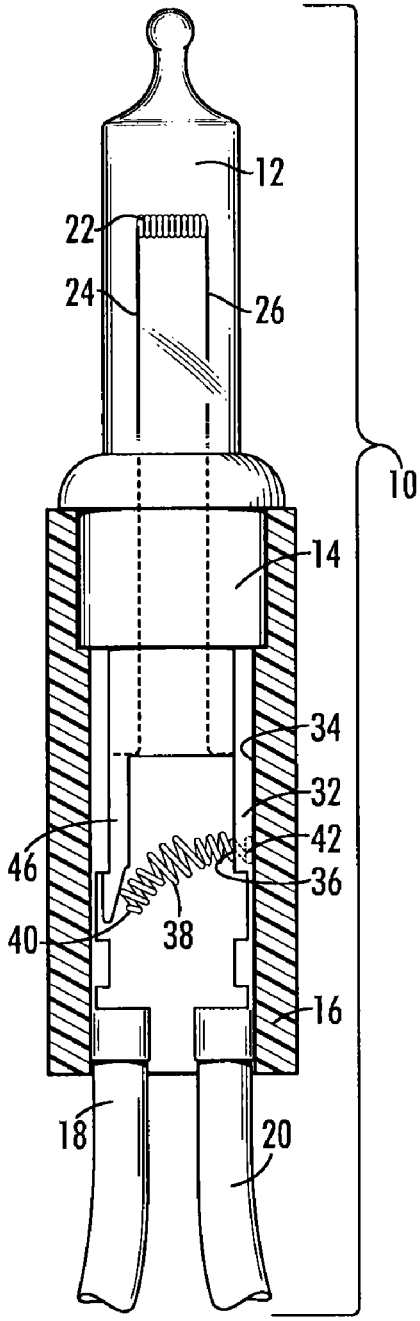
FIG. 3 is a side cross-sectional view of the socket of the present invention showing the lamp seated therein with the tooth of the bulb holder disengaging the shunt from one of the electrical terminals, according to one embodiment of the present invention.

FIGS. 2 and 3 illustrate a lamp 10 in side view. Lamp 10 includes a bulb 12, a bulb holder 14, and a socket 16. FIGS. 2 and 3 show bulb 12 and bulb holder 14 partially removed from and fully inserted into socket 16, respectively. Socket 16 is shown in cross-section in both figures. Two insulated electrical wires, a first insulated wire 18 and a second insulated wire 20, extend into socket 16 from the adjacent lights in the light string or the plug 4 or receptacle 6 at the ends of the light string. Within socket 16, first and second electrical terminals 30 and 32 are in electrical contact with first and second insulated wires 18 and 20, respectively. Bulb 12 is a partially-evacuated transparent housing with a coiled filament 22 connected between a first and an opposing second Dumet wire 24 and 26 inside bulb 12. Dumet wires 24 and 26 extend from the interior of bulb 12 to its exterior and through at least one hole formed in holder 14. Once emerging from the holes in holder 14, Dumet wires 24 and 26 are folded back against the sides of holder 14 in order to be in position to make contact with first and opposing second electrical terminals 30 and 32 when bulb holder 14 is inserted into socket 16.

Second electrical terminal 32 has a hole 36 formed therein; first electrical terminal 30 does not need a hole but may be formed with a hole so that first and second electrical terminals 30 and 32 are identical. A spring shunt 38, which runs from second electrical terminal 32 toward first electrical terminal 30 across the interior of socket 16 may be in the form of a coil of wire and may have slightly larger coils in its mid-section. A coil shape is believed to be better able than a leaf spring to remain intact after repeated and extended deflections. Spring shunt 38 has a first end 40 and an opposing second end 42. Second end 42 is inserted far enough into hole 36 of second electrical terminal 32 to securely affix spring shunt 38 to second electrical terminal 32. Moreover, spring shunt 38 is long enough to be cantilevered across the gap between first and second electrical terminals 30 and 32 and make electrical contact with first electrical terminal 30. The spring shunt has a central section having coils of a first diameter and the first and opposing second ends of the spring shunt have coils of a second diameter and the first diameter is greater than the second diameter. As it is well known in the art, the use of different diameters within a spring allows to control the bending movement of the spring.

When bulb holder 14 is partially removed from socket 16, as illustrated in FIG. 2, shunt spring 38 bridges the gap between first and second electrical terminals 30 and 32 and allows electrical current to flow therebetween and through first and second insulated wires 18 and 20. When bulb holder 14 is seated in socket 16, as illustrated in FIG. 3, two important things happen. First, Dumet wires 24 and 26 engage first and second terminals 30 and 32, thereby allowing, when first and second insulated wires 18 and 20 are energized, electrical current to flow in a first conductive path through first and second terminals 30 and 32, first and second Dumet wires 24 and 26, and filament 22. Second, a tooth 46 carried on one side of bulb holder 14 (preferably a bottom corner of bulb holder 14), is interposed between the first end 40 of spring shunt 38 and first electrical terminal 30, thereby breaking the electrical connection therebetween that previously resulted in the bypassing of filament 22. This break in the flow of electricity through spring shunt 38, together with the insertion of bulb holder 14 and the resulting contact between Dumet wires 24 and 26 and electrical terminals 30 and 32, changes the electrical flow from what it was previously. That is, namely, through first electrical terminal 30 to first Dumet wire 24, then to filament 22, second Dumet wire 26, and thence to second electrical terminal 32. Likewise, removal of holder 14 withdraws tooth 46 from socket 16 and allows first end 40 of spring shunt 38 to resiliently spring back into electrical contact with first electrical terminal 30.

To prevent arcing when bulb holder 14 is inserted into or removed from socket 16, it is important for a new electrical connection to be established before the original connection is broken. Accordingly, the tooth 46 must be dimensioned and positioned so that, when inserting the bulb holder 14 into the socket 16, first and second Dumet wires 24 and 26 contact first and second electrical terminals 30 and 32 before tooth 46 breaks contact between spring shunt 38 and first electrical terminal 30. Likewise, tooth 46 must also be dimensioned and positioned so that, when removing the bulb holder 14 from the socket 16, the tooth 46 releases spring shunt 38 allowing it to resume contact with first electrical terminal 30 before first and second Dumet wires 24 and 26 lose contact with first and second electrical terminals 30 and 32. Thus, arcing is avoided both on the insertion and withdrawal of holder 14 from socket 16.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. A light for use in a light string, said light comprising:

a bulb;

a filament in said bulb;

a bulb holder carrying said bulb, said bulb holder having at least one hole therethrough;

a tooth depending from said bulb holder;

a first and a second Dumet wire extending from said filament inside said bulb through said at least one hole in said bulb holder to the exterior of said bulb holder;

a socket carrying said bulb holder, said bulb holder removably seatable in said socket, said socket having an interior wall;

a first and an opposing second electrical terminal carried by said interior wall of said socket, said first and second Dumet wires engaging said first and second electrical terminals, respectively, when said bulb holder is seated in said socket, said second electrical terminal having a hole formed therein;

a spring shunt having a first and an opposing second end, said second end being inserted into said hole in said second electrical terminal so that said spring shunt is cantilevered across said interior of said socket toward said first electrical terminal, said tooth on said bulb holder being interposed between said first end of said spring shunt and said first electrical terminal when said bulb holder is in said socket so that electricity does not flow between said first electrical terminal and said spring shunt but rather from said first electrical terminal to said first Dumet wire and then to said filament and to said second Dumet wire and then to said second electrical terminal, said tooth allowing said spring to return resiliently into electrical engagement with said first electrical terminal when said bulb holder is removed from said socket, said spring shunt thereafter passing current directly from said first electrical terminal to said second electrical terminal and bypassing said filament;

wherein said spring shunt is a coiled spring; and wherein said spring shunt has a central section having coils of a first diameter and said first and opposing second ends of said spring shunt have coils of a second diameter and wherein said first diameter is greater than said second diameter.

2. The light as recited in claim 1, wherein said bulb holder has at least one corner and said tooth depends from said at least one corner of said bulb holder.

3. The light as recited in claim 1, wherein said first electrical terminal has a hole therein.

4. The light as recited in claim 1, wherein said tooth is dimensioned so that, when said bulb holder is inserted into said socket, said first end of said spring shunt is pushed out of electrical engagement with said first electrical terminal after said first and said second Dumet wires are in electrical contact with said first and said second electrical terminals, respectively.

5. The lamp as recited in claim 1, wherein said tooth is dimensioned so that, when said bulb holder is removed from said socket, said first end of said spring shunt resiliently returns to electrical engagement with said first electrical terminal before said first and second Dumet wires lose electrical contact with said first and second electrical terminals, respectively.

* * * * *